US006520085B1

(12) United States Patent
Heiler et al.

(10) Patent No.: US 6,520,085 B1
(45) Date of Patent: Feb. 18, 2003

(54) DEVICE FOR TENSIONING A CYLINDER DRESSING ON A PRINTING MACHINE-CYLINDER

(75) Inventors: Peter Heiler, Forst (DE); Frank Kropp, Mauer (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/449,718

(22) Filed: Nov. 24, 1999

(30) Foreign Application Priority Data

Nov. 26, 1998 (DE) ..... 198 54 526

(51) Int. Cl.[7] ..... B41F 27/12
(52) U.S. Cl. ..... 101/415.1; 101/378
(58) Field of Search ..... 101/415.1, 378, 101/409, 485, 486, DIG. 36, 246

(56) References Cited

U.S. PATENT DOCUMENTS

| | | | | | |
|---|---|---|---|---|---|
| 629,932 | A | | 8/1899 | Spalckhaver | 101/415.1 |
| 1,074,775 | A | | 10/1913 | Cornwall | 101/395 |
| 2,668,498 | A | * | 2/1954 | Boyajean, Jr. | 101/415.1 |
| 2,837,994 | A | | 6/1958 | Brodie | 101/415.1 |
| 2,869,966 | A | * | 1/1959 | Cunningham | 101/415.1 |
| 3,012,841 | A | * | 12/1961 | Autere et al. | 101/415.1 |
| 3,605,621 | A | | 9/1971 | Woessner et al. | 101/415.1 |
| 3,757,691 | A | | 9/1973 | Etchell et al. | 101/415.1 |
| 3,824,928 | A | | 7/1974 | Langer | 101/415.1 |
| 4,367,679 | A | | 1/1983 | Ishii et al. | 101/415.1 |
| 5,003,878 | A | * | 4/1991 | Dorow et al. | 101/415.1 |
| 5,069,127 | A | | 12/1991 | Iijima et al. | 101/415.1 |
| 5,337,666 | A | | 8/1994 | Becker | 101/415.1 |
| 5,709,151 | A | * | 1/1998 | Dürr et al. | 101/415.1 |

FOREIGN PATENT DOCUMENTS

| | | |
|---|---|---|
| DE | 388 029 | 10/1921 |
| DE | 1 936 396 | 1/1971 |
| DE | 2 328 985 | 1/1974 |
| DE | 140 439 | 3/1980 |
| DE | 31 00 114 A1 | 11/1981 |
| DE | 42 22 332 A1 | 1/1994 |
| EP | 0 110 908 B1 | 11/1986 |
| GB | 1 230 898 | 5/1971 |

* cited by examiner

*Primary Examiner*—Leslie J. Evanisko
(74) *Attorney, Agent, or Firm*—Herbert L. Lerner; Laurence A. Greenberg; Werner H. Stemer

(57) ABSTRACT

A device for positioning and tensioning a cylinder dressing on a printing-machine cylinder, wherein both a leading dressing end and a trailing dressing end of the cylinder dressing are tensioned, includes, in a first step, tensioning both dressing ends, and in a second step, relieving the tension in a first of the two dressing ends, while retensioning a second of the dressing ends; and a printing machine provided with the device.

9 Claims, 7 Drawing Sheets

DEVICE FOR TENSIONING A CYLINDER DRESSING ON A PRINTING MACHINE-CYLINDER

BACKGROUND OF THE INVENTION

FIELD OF THE INVENTION

The invention relates to a method for positioning and tensioning a cylinder dressing on a printing-machine cylinder, including both a leading end of a dressing and a trailing end of a dressing. The invention, furthermore, relates to a device for holding and tensioning a cylinder dressing on a printing-machine cylinder, the device having a first arm for holding a first end of a dressing, a second arm for holding a second end of the dressing, and a cam member rotatable for adjusting the first and second arms.

Such a method can be performed, for example, by the device described heretofore in the published German Patent Document DE 42 22 332 C2, the cylinder dressing being tensioned and relieved of tension simultaneously at the leading edge and trailing edge thereof due to the construction of this device. The cylinder dressing in the form of a rubber blanket can be displaced relative to the original position thereof on the jacket of a printing-machine cylinder. For this purpose, the rubber blanket is relieved of tension at the leading edge and the trailing edges thereof by an actuating drive, a toothed quadrant clamping being released at a tension spindle, and the latter being rotated an adjusting travel distance.

SUMMARY OF THE INVENTION

Proceeding from this state of the prior art, it is an object of the invention to provide an improved method for tensioning and positioning a cylinder dressing on a printing machine cylinder.

With the foregoing and other objects in view, there is provided, in accordance with one aspect of the invention, a method for positioning and tensioning a cylinder dressing on a printing-machine cylinder, wherein both a leading dressing end and a trailing dressing end of the cylinder dressing are tensioned, which comprises, in a first step, tensioning both dressing ends, and in a second step, relieving the tension in a first of the two dressing ends, while retensioning a second of the dressing ends.

In accordance with another mode of the method of the invention, the first of the two dressing ends is the leading dressing end, and the second of the two dressing ends is the trailing dressing end.

In accordance with a further mode, the method of the invention, comprises successively tensioning the dressing ends in the first step.

In accordance with an added mode, the method of the invention comprises initially tensioning the trailing dressing end, and subsequently tensioning the leading dressing end in the first step.

In accordance with an additional mode, the method of the invention comprises tensioning both of the dressing ends simultaneously in the first step.

In accordance with another aspect of the invention, there is provided a device for holding and tensioning a cylinder dressing on a printing-machine cylinder, the device having a first arm for holding a leading dressing end of the cylinder dressing, and a second arm for holding a trailing dressing end of the cylinder dressing, and a rotatable cam member for adjusting the first and second arms, comprising a first tension lever pivotable about a first rotary joint, and a second tension lever pivotable about a second rotary joint, the first arm being formed on the first tension lever, and the second arm being formed on the second tension lever.

In accordance with another feature of the invention, the tension levers are loaded by altogether at least one spring.

In accordance with a further feature of the invention, the first rotary joint and the second rotary joint are disposed coaxially with one another.

In accordance with an added feature of the invention, the rotary joints are disposed so as to be offset eccentrically relative to an axis of rotation of the printing-machine cylinder.

In accordance with an additional feature of the invention, at least one spring extends through the first rotary joint and through the second rotary joint.

In accordance with yet another feature of the invention, the at least one spring is a torsion bar spring.

In accordance with yet a further feature of the invention, the tension levers are formed as rockers, and each of the rockers has a first rocker arm for holding the cylinder dressing, and a second rocker arm actuatable by the cam member.

In accordance with yet an added feature of the invention, the device includes a respective roller engageable by the cam member being mounted rotatably in each of the second rocker arms.

In accordance with yet an additional feature of the invention, the tension levers, respectively, carry a clamping device for holding the cylinder dressing.

In accordance with a concomitant aspect of the invention, there is provided a printing machine having at least one device for positioning and tensioning a cylinder dressing having at least one of the foregoing features.

Thus, the method for positioning and tensioning a cylinder dressing on a printing-machine cylinder, which includes tensioning both a front or leading dressing end and a rear or trailing dressing end, is distinguished in that, in a first method step, the two dressing ends are tensioned and, in a second method step following the first method step, a first dressing end of the two dressing ends is relieved of tension or detensioned, and a second dressing end of the two dressing ends is retensioned.

The cylinder dressing can be displaced in circumferential direction on the circumferential surface of the cylinder in this simple way, in practice the first dressing end being pushed and the second dressing end being pulled in the tensioning direction of the second dressing end. In relation to the tension of the first dressing end achieved in the first method step, often only partial detensioning or relief of tension is necessary in the second method step. The detensioning of the first dressing end may commence either before the retensioning of the second dressing end or simultaneously therewith. In both cases, the second dressing end is retensioned during the detensioning of the first dressing end.

Certain cylinder dressings have to be tensioned, in practice, by pulling on both dressing ends in tensioning directions opposite to one another, so that the cylinder dressings can be tensioned so as to rest tautly on the cylinder. The need for tensioning these cylinder dressings at both ends is due to friction between the cylinder dressing and the supporting surface of the cylinder, this friction being comparable to rope friction and being capable of being overcome only by pulling on both ends.

The method according to the invention is based on the assumption that even cylinder dressings to be tensioned in this way can be displaced on the circumferential surface of the cylinder if displacement is preceded by tensioning at both ends. It is assumed that, during clamping, disruptive deformations of the cylinder dressing play a part, as well as the rope friction-like effect. Often permanent deformations become noticeable, particularly after lengthy use and the associated repeated clamping and removal of the cylinder dressing on and off the cylinder. Such deformations can be eliminated by taut tensioning at both ends which precedes displacement, so that the cylinder dressing can subsequently be displaced, and exactly positioned, on the circumferential surface of the cylinder more easily than has been assumed hitherto.

Preferably, a leading dressing end corresponds to the first dressing end and a trailing dressing end to the second dressing end, so that, in the second method step, the leading dressing end is at least partly detensioned, and the trailing dressing end is retensioned. By the leading or front dressing end there is meant that end which, when the printing-machine cylinder carrying the cylinder dressing rolls in operative contact with or on a further printing-machine cylinder, is guided first past the further printing-machine cylinder during each revolution. In the event that the printing-machine cylinder is a plate cylinder for applying a printing ink or a varnish to a print carrier and the other printing machine cylinder is an impression cylinder guiding the print carrier, the so-called print start of the printing or varnishing plate is located at the front or leading dressing end.

In a mode of the method according to the invention, in the first method step, the dressing ends are tensioned in succession. Preferably, in the first method step, first the trailing dressing end and subsequently the leading dressing end can be tensioned.

In a further mode of the method, in the first method step, both dressing ends are tensioned simultaneously.

A device constructed as described in the introduction hereto is illustrated, for example, in FIGS. 1 to 3 of the published German Patent Document DE-OS 23 28 985. In this device, the arms are not formed as tension levers, respectively, pivotable about a rotary joint, but are each movable about a bending point of a U-shaped spring. The arms are also not loaded by a spring, but are themselves resiliently elastic and are parts of the U-shaped spring.

One disadvantage of this heretofore known device is that the printing plates cannot be aligned exactly in position by this device because, depending upon the expandability of the particular type of clamped printing plate, the arms bend to a greater extent at one time and to a lesser extent at another time. In conjunction therewith, there is also the comparatively low tensioning action which can be achieved by the U-shaped spring. Moreover, the method according to the invention cannot be performed by this device, because, as a consequence of design, always only one dressing end is tensioned by an arm, while the other dressing end is held fixedly in location on the printing-plate cylinder.

Proceeding from this state of the prior art, it is thus an object of the invention, furthermore, to provide a device for holding and tensioning a cylinder dressing on a printing machine cylinder, that can be operated conveniently and be suitable, in particular, for performing the method according to the invention.

This object is achieved, according to the invention, by providing the device for holding and tensioning a cylinder dressing on a printing-machine cylinder, with a first arm for holding a leading dressing end and a second arm for holding a trailing dressing end, and with a rotatable cam part for adjusting the two arms, in particular for performing the method according to the invention, which is distinguished in that the first arm is formed on a first tension lever pivotable about a first rotary joint and the second arm is formed on a second tension lever pivotable about a second rotary joint.

By the cam member, there is meant, for example, a control shaft with two cams which are seated on the shaft so as to be offset relative to one another in the axial direction of the latter, a first cam thereof serving to adjust the first arm, and a second cam the second arm. By the cam member, there is likewise meant a control shaft with a cam disk seated on the latter, the cam disk adjusting both the first arm and the second arm. An eccentric shaft functionally identical to the above variants and profiled correspondingly is also such a cam member. It is essential that the two arms be adjustable in succession and/or simultaneously as a result of a rotation of the cam member about the axis thereof which preferably extends axially parallel to the axis of rotation of the cylinder.

When compared with the device belonging to the prior art represented by the aforementioned published German patent Document DE-OS 23 28 985, the device according to the invention has the advantage that cylinder dressings can be aligned precisely in position by the device according to the invention. In the device according to the invention, the arms may be rigid, so that the cylinder dressing held on the arms can be positioned, irrespective of the expandability thereof, by an appropriate adjustment of the arms.

An improved embodiment of the device according to the invention is distinguished in that the tension levers are loaded by altogether at least one spring.

In this case, each tension lever may have assigned thereto at least one spring transmitting the tensioning force to the tension lever. Each of these springs may be supported on the basic cylinder body, in which the tension levers may be mounted via the rotary joints. Preferably, at least one spring bracing the two tension levers relative to one another may also be provided. In this case, the tension levers may form, together with the spring acting therebetween, a tension unit adjustable substantially in the circumferential direction relative to the basic cylinder body without any variation in the tensioning force for tensioning the cylinder dressing. By the one spring or the plurality of springs, substantially higher tensioning forces can be generated than is possible with resiliently constructed arms. Due to the rigidity of the arms, the stability of the tensioning device as a whole increases and distortion-free tensioning of the cylinder dressing can be performed very effectively.

A further embodiment is distinguished in that the first rotary joint and the second rotary joint are arranged coaxially to one another.

This affords possibilities, advantageous in terms of construction, for the at least one spring loading the tension levers to be arranged coaxially with the joints. In a first variant or alternative embodiment, one of the rotary joints may be seated concentrically on the other rotary joint. In a preferred second variant, the rotary joints are arranged so as to be offset relative to one another in the axial direction thereof. For example, according to the second variant, a joint bushing, which is fastened to the respective tension lever and which is rotatable on a joint pin, may be seated on each of the two ends of the latter. Between the joint bushings, a leg spring applying the tensioning force may be wound helically around the joint pin, the leg spring being supported with each of the two legs thereof, respectively, on one of the tension levers and bracing the latter relative to one another. The common central axis of the rotary joints may correspond to the axis of rotation of the printing-machine cylinder both in the first variant and in the second variant.

A further embodiment is distinguished in that the rotary joints are arranged so as to be offset eccentrically relative to an axis of rotation of the printing-machine cylinder.

The advantage of this embodiment is that an advantageous division of construction space in the cylinder interior is achieved. The rotary joints of the tension levers, the rotary joints being offset eccentrically relative to the axis of rotation of the cylinder, may be arranged so as to be offset relative to one another, the joint axes extending axially parallel to one another and axially parallel to the axis of rotation of the cylinder. Preferably, the rotary joints are arranged coaxially with one another, the common axis of rotation being arranged so as to be offset eccentrically and so as to be axially parallel to the axis of rotation of the cylinder.

A further embodiment is distinguished in that a single spring or a respective spring extends through the first rotary joint and through the second rotary joint.

In this case, the joint pins of the rotary joints may be formed as tubular hollow bodies, respectively, whereon the tension levers, for example, carried by joint bushings, are seated. The spring may be inserted into the hollow bodies in a formlocking connection with the hollow bodies, that is fixed against rotation. In this regard, it is noted that a formlocking connection is one which connects two elements together due to the shape of the elements themselves, as opposed to a forcelocking connection, which locks the elements together by force external to the elements. In an alternative embodiment, a common joint pin of both rotary joints, whereon the tension levers are seated rotatably, may be formed as a single tubular hollow body through which the spring extends.

A further embodiment is distinguished in that the spring or the respective spring is a torsion bar spring.

By a torsion bar spring, high tensioning forces of, for example, 8 kN for tensioning a varnishing blanket or 12 kN for tensioning a varnishing plate can be applied, the torsion bar spring taking up only comparatively little construction space. In specific applications, one or more compression springs constructed, for example, as helical springs may also be used for bracing the tension levers relative to one another.

A further embodiment is distinguished in that the tension levers are formed as rockers, and each of the rockers has a first rocker arm holding the cylinder dressing, and a second rocker arm actuatable by the cam member.

The second rocker arms may temporarily come into and out of contact with the cam member due to the actuation of the latter. Preferably, the second rocker arms are held in predominantly permanent bearing contact on the rotating cam member, so that the position of the tension levers is reliably fixed.

A further embodiment is distinguished in that a roller contactable by the cam member is mounted rotatably in each of the second rocker arms.

The rollers can roll on the cam member, so that convenient ease of movement of the adjusting device is afforded and any abrasive wear of the cam member or of the tension levers is avoided.

A further embodiment is distinguished in that the tension levers, respectively, carry a clamping device for holding the cylinder dressing. For this purpose, a clamping device for clamping the leading dressing end may be arranged on the first rocker arm of the first tension lever, and a further clamping device for clamping the trailing dressing end may be arranged on the first rocker arm of the second tension lever. The clampings can be produced and released very quickly, so that an exchange of the cylinder dressing for another cylinder dressing takes up only a little time.

The device can be used in rotary printing machines and, for example, offset printing machines. The printing-machine cylinder may be a coating cylinder for coating the print carrier of a coating unit which is located upline or downline of the printing units of the printing machine and which is equipped with the device.

Other features which are considered as characteristic for the invention are set forth in the appended claims.

Although the invention is illustrated and described herein as embodied in a method and device for tensioning a cylinder dressing on a printing-machine cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
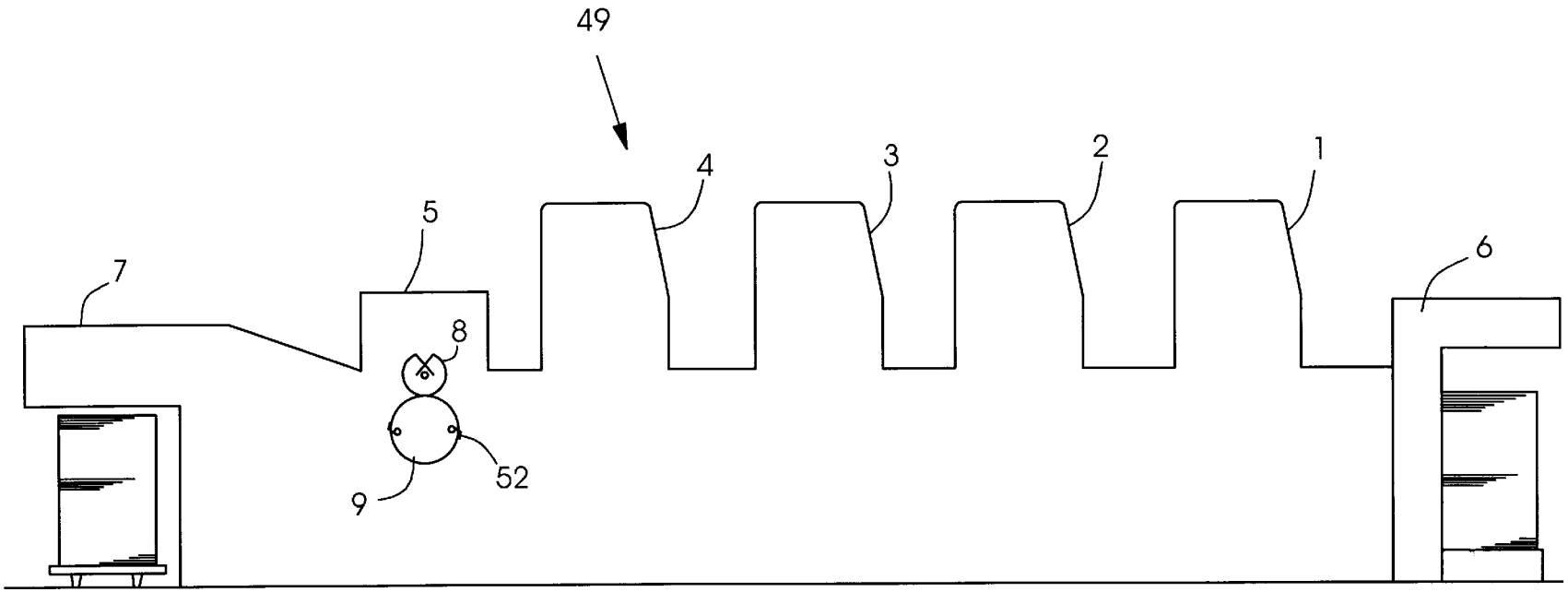
FIG. 1 is a diagrammatic side elevational view of a printing machine having a coating unit provided with a coating cylinder that is equipped with the tensioning device according to the invention.

Referring now to the drawings and, first, particularly to FIG. 1 thereof, there is shown therein a printing machine 49 constructed as an offset rotary printing machine and having a plurality of row-wise arranged printing units 1 to 4, a sheet feeder 6 and a sheet delivery 7. The printing machine 49 has a coating unit 5 disposed between the last printing unit 4 and the sheet delivery 7, and may also be disposed between the sheet feeder 6 and the first printing unit 1. The coating unit 5 includes two cooperating printing-machine cylinders 8 and 9, namely, the coating cylinder 8 for applying a coating liquid, such as a varnish, for example, to a printing-material or carrier sheet, and the impression cylinder 9 whereon the printing-material or carrier sheet lies during the coating operation.

Figure 2:
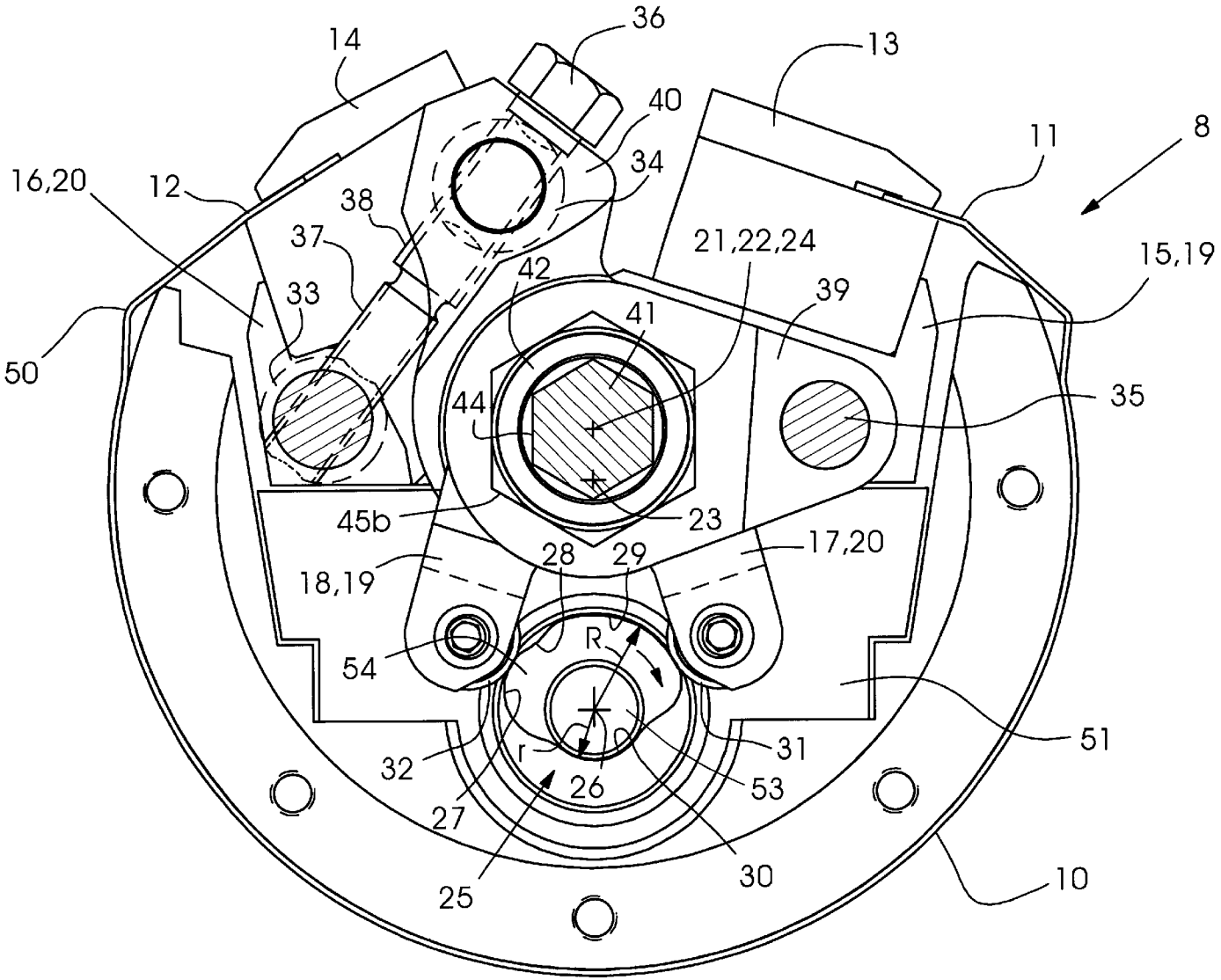
FIG. 2 is a cross-sectional view, taken along the line II—II in hereinafter-described FIG. 7, of the coating cylinder, the tensioning device of which is in a first tensioning position, wherein it holds a cylinder dressing in an untensioned manner at both dressing ends.

FIG. 2 illustrates the coating cylinder 8 in cross section, with a view of a device, arranged in the cylinder interior, for tensioning different cylinder dressings 10 which may be a rubber blanket or a polyester plate for varnish application or, as shown, a varnishing plate having an aluminum carrier base.

The cylinder dressings 10 formed of different materials require different tensioning travels and tensile forces which are applied by the spring 41 formed as a torsion bar spring 41 and capable of being subjected to torsional stress and of being varied by an adjusting or setting device 33, 34, 36 to 38, in that the prestressing of the spring 41 is regulatable for adaptation to the materials. By the tensioning device that is adjustable to different tensioning forces, previously used and, therefore, preformed cylinder dressings 10, which usually require a somewhat higher tensioning force, when compared with unused cylinder dressings 10, can also be tensioned very effectively. The coating cylinder 8 meshes with the grippers 52 of the impression cylinder 9 (FIG. 1), with the result that a steep angle of entry of the cylinder dressing 10 at the leading edge 12 into the coating cylinder 8 is necessary, when compared with the flat angle of entry of a plate cylinder of an offset printing unit, that cooperates with a gripperless rubber blanket cylinder. In these offset plate cylinders, it is sufficient, when an offset printing plate is being tensioned, to pull or draw the latter solely at the trailing edge thereof, while the leading edge thereof can remain held in position. By contrast, with the coating cylinder 8 shown, it is advantageous, during tensioning, to pull not only on the trailing dressing end 11, but also on the leading dressing end 12, in order to extract or draw out the air located under the cylinder dressing 10 in this region, because plates having a particularly strong tendency to lie hollow and being used as a cylinder dressing 10 would otherwise possibly be destroyed.

The device according to the invention makes it possible not only to provide spring-assisted tensioning of the cylinder dressing 10 at both ends thereof, but also to position the dressing 10 on the coating cylinder 8, the so-called print start located at the front dressing end 12 being capable of being aligned in a reproducibly accurate manner via a cam control 25 to 32 during the tension-mounting of the cylinder dressing 10, in that the cylinder dressing 10 is displaceable on the coating cylinder 8 by an adjustment of both the leading dressing end 12 and the trailing dressing end 11. Moreover, the cylinder dressing 10 tension-mounted on the circumferential surface of the coating cylinder 8 can be displaced slightly in both circumferential directions by the cam control 25 to 32, for example, for the purpose of adjusting or setting a manual circumferential register.

As is apparent in FIG. 2, the leading dressing end 12 is clamped, yet untensioned, in a front or leading holding device 14, and the trailing dressing end 11 in a rear or trailing holding device 13. The holding devices 13 and 14, formed as clamping devices, are carried, respectively, by first rocker arms 15 and 16, the first rocker arm 16, together with a second rocker arm 17, forming a first tension lever 20 in the form of a rocker 20, and the first rocker arm 15, together with a second rocker arm 18, forming a second tension lever 19 in the form of a rocker 19. In particular applications, the tension levers 19 and 20 may also be formed as one-armed levers, contrary to the form thereof shown in the figures. The tension levers 19 and 20 are pivotable about the coaxially disposed articulating joints 21 and 22 thereof, a common pivot axis 24 of the joints 21 and 22 being offset eccentrically relative to a cylinder axis 23 in the direction of a tensioning gap that is free between the dressing ends 11 and 12, the pivot axis 24 extending axially parallel to the cylinder axis 23.

Offset precisely in a radial direction opposite to the pivot axis 24 is a cam axis 26, extending axially parallel to the cylinder axis 23, of a cam member 25 that is disposed between the tension levers 19 and 20 or the second rocker arms 17 and 18 thereof and that is formed of an actuating shaft 53 that is rotatable about the cam axis 26 and of a cam disk 54 seated on the actuating shaft 53 and having various circumferential cam regions 27 to 30. The tension levers 19 and 20, respectively, are provided with respective cam rollers 31 and 32 which roll simultaneously on the cam member 25 during rotation of the latter. In particular applications, the rollers 31 and 32 may be omitted, so that the cam member 25 actuates the tension levers 19 and 20 by direct contact. Also, in a modification of the example shown, the actuating shaft 53 may have two cam disks 54 seated thereon which are arranged in alignment in the axial direction thereof and include a first cam disk assigned to the tension lever 19 and the roller 32, respectively, and a second cam disk assigned to the tension lever 20 and the roller 31, respectively.

The spring 41 braces the two tension levers 19 and 20 relative to one another, whereby, on the one hand, the first rocker arms 15 and 16 and the holding devices 13 and 14 therewith and, on the other hand, the second rocker arms 17 and 18, respectively, are pulled toward one another, the result of which is that, when the cam member 25 is in a corresponding rotary position, the cylinder dressing 10 is tensioned or tautened and the rollers 31 and 32 are pressed against the cam member 25.

The cam member 25, and the cam disk 54 thereof particularly, has a stop or catching circle equidistant from the cam axis 26 and having a large radius R, and a likewise equidistant stop or catching circle having a small radius r, the two stop or catching circles merging smoothly into one another via a transitional region wound in a S-shaped manner and a transitional region wound in a mirror-symmetrically S-shaped manner. The catching or stop circle having the large radius R has a flat or concave indentation that forms the cam region 28 and that lies in the second quadrant when the cam member 25 is in the middle position shown in FIG. 2. With the exception of the cam region 28, the cam disk 54 has a mirror-symmetrical form, the catching or stop circle having the larger radius R extending over a larger circumferential angle than, and approximately over double the circumferential angle of, the catching or stop circle having the smaller radius r. As viewed clockwise in FIG. 2, the indentation 28 is followed, in order, by a convex region 29, a first transitional region, a convex region 30, a second transitional region and a convex region 27.

FIG. 2 illustrates the cam member 25 in a middle position, wherein the tension levers 19 and 20 are spread apart to a maximum extent, this being true both for the second rocker arms 17 and 18 and for the first rocker arms 15 and 16 in the case of the crosswise arranged rocker-like tension levers 19 and 20 shown, so that the rocker arms 15 and 16 hold the cylinder dressing 10 untensioned at both ends thereof. In this middle position, in the region of the first quadrant, the first tension lever 20 bears via the roller 31 on the circular-arcuate cam region 29 and, in the region of the second quadrant, the second tension lever 19 bears via the roller 32 on the circular-arcuate cam region 27.

The setting or adjusting device 33 to 38 for setting different and dressing-dependent prestresses and tensioning forces of the torsion bar spring 41 includes a screw 36 that is provided with different threads 37 and 38, specifically with a righthand thread 37 and a lefthand thread 38, so that, during one revolution of the screw, double the adjusting travel can be achieved, as compared with a conventional screw of the same thread pitch, the setting device 33 to 38 taking up comparatively little construction space. During a rotational movement of the screw 36 about the longitudinal axis thereof, the first tension lever 20 and a first supporting arm 40 seated in a formlocking connection 45*a* fixed against rotation on a first tube 42 are adjustable selectively towards or away from one another, depending upon the direction of rotation of the screw 36. For this purpose, the screw 36 is threaded with the righthand thread 37 thereof in a first connecting bolt 33, rotatably mounted axially parallel to the cylinder 8 in the first tension lever 20, and with the lefthand thread 38 thereof in a connecting bolt 33, likewise mounted in the first supporting arm 40. When the screw 36 is tightened or released, the bolts 33 and 34 rotate within the tension lever 20 and the first supporting arm 40, respectively. The righthand and the lefthand threads may, of course, be provided in an interchanged arrangement and, if there is sufficient construction space, there may be a single thread.

Figure 7:
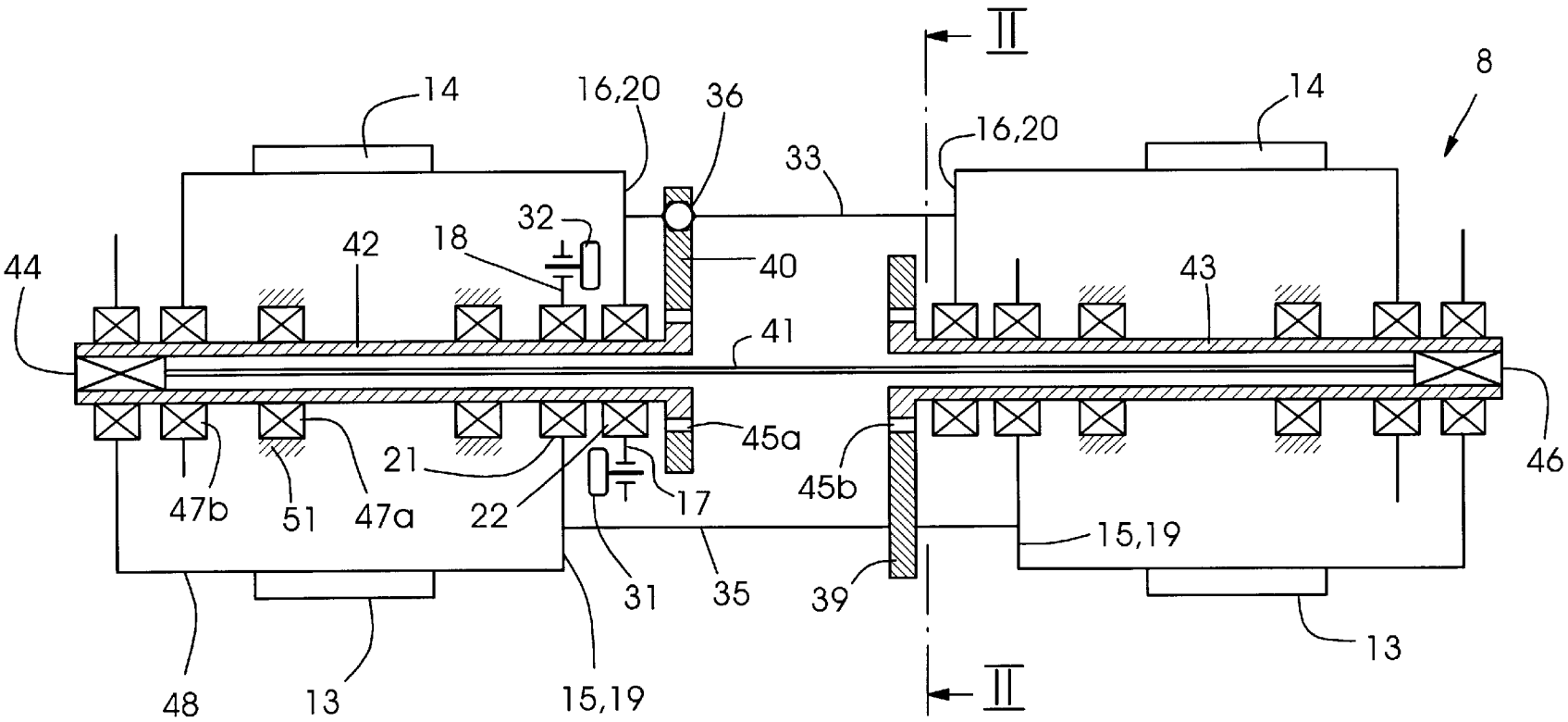
FIG. 7 is a reduced, diagrammatic top plan view, partly in longitudinal section, of the tensioning device shown in FIGS. 2 to 6.

FIG. 7 should also be referred to for a better understanding of the rest of the description that follows.

The second tension lever 19 is connected in an articulated manner to a second supporting arm 39 via a second connecting bolt 35. The second supporting arm 39 is seated in a formlocking connection 45*b* fixed against rotation on a second tube 43. The spring 41 extends through both tubes 42 and 43 mounted rotatably in the basic cylinder body 51 by the rotary bearings 47*a*, 47*b*, and each of the tubes 42 and 43 is connected to the spring 41 in a respective formlocking connection 44, 46 fixed against rotation. The tubes 42 and 43 may, for example, be polygonal on the inside, and having, for example, as shown, a hexagonal profile that may be capable of being plugged tautly onto a corresponding outer counterpiece of the spring 41. A comparable plug connection, that is fixed against rotation, of the supporting arms 39 and 40 to the tubes 42 and 43 can be achieved by the illustrated inner hexagonal profiling of the supporting arms 39 and 40, and the outer hexagonal profiling of the tubes 42 and 43.

Shaft/hub connections other than those described, which are very suitable for the transmission of high forces, for connecting the tubes 42 and 43 to the spring 41, and the tubes 42 and 43 to the supporting arms 39 and 40 are also possible. The tension levers 19 and 20 are mounted rotatably on the tubes 42 and 43 by the rotary bearings 47*b*. The second tension lever 19 is formed of two parts which are connected to one another by the second connecting bolt 35, and each of the two parts is formed, in turn, of two parallel-guided pivoting levers connected by a crossmember 48 and mounted rotatably on the tube 42, the holding devices 13 being arranged on these crossmembers 48. The first tension lever 20 is of multipartite construction, in the same way, the parts thereof being connected by the first connecting bolt 33. In order to achieve a very high rigidity, the first tension lever 20, instead of having a construction composed of the crossmember and the pivoting levers, may also be produced as a single solid structural part, for example by a casting method.

When the screw 36 is rotated clockwise, the connecting or joint bolt 34 and the supporting arm 40 therewith are pulled in the direction of the connecting bolt 33 or first rocker arm 16 of the first tension lever 20. The second rocker arm 17 of the first tension lever 20 is held in substantially permanent bearing contact on the cam member 25 by a readjusting action of the spring 41. Due to the presence of the connection 45*a* that is fixed against rotation, the pivoting of the supporting arm 40 causes the tube 42 to rotate about the central axis 24 thereof. The rotation of the tube 42 is transmitted via the connection 44, that is fixed against rotation, to the spring 41 at one end of the latter. The spring 41 is retained at the other end thereof by the connection 46 that is fixed against rotation, so that the rotation of the first-mentioned spring end causes torsion of the spring 41 about the longitudinal axis thereof. The connection 46 itself, that is fixed against rotation and forms a torsion abutment, is retained by the tube 43 in the rotary position shown, the tube 43 being supported indirectly on the cam member 25 via the supporting arm 39, the connecting bolt 35 and the second tension lever 19 and the second rocker arm 18 thereof, respectively.

The entire tension system, formed of the tension levers 19 and 20, respectively, braced relative to one another by the spring 41, the tubes 42 and 43, the supporting arms 39 and 40 and the spring 41 itself, is rotatably mounted, as a so-called floatingly mounted system, i.e., as a structural unit adjustable as a whole, in the basic cylinder body 51 via the rotary bearings 47*a*. The advantage thereof is that the tension system can be adjusted, by rotation of the cam member 25, about the joint axis 24 lying near the cylinder axis 23, for example, in order to displace the cylinder dressing 10 so as to effect an adjustment of the circumferential register. The cam member 25 shown in FIG. 2 is not illustrated again in FIG. 7 in the interest of greater clarity. As a result of the rotation of the cam member 25, one of the two tension levers 19 and 20 is pressed by the cam member 25 in the direction of circumferential adjustment of the tension system which corresponds to the register adjustment direction in the illustrated example, and the other tension lever 19, 20 is readjusted in the same adjustment direction by the spring 41.

During the rotation of the cam member 25 in one direction of rotation, for example clockwise, as shown in FIGS. 2 to 5, the cam contour 26 to 30 of the latter causes a specific sequence in the actuation of the tension levers during tension mounting and, at the same time, a displacement of the cylinder dressing 10 to be positioned on the cylinder circumference.

In the position shown in FIG. 2, both the first tension arm 20 holding the leading dressing end 12 of the cylinder dressing 10 is supported on the cam member 25 via the roller 31 bearing on the cam region 29, and the second tension arm 19 holding the trailing dressing end 11 is supported on the cam member 25 via the roller 32 bearing on the cam region 27. In this case, both rollers 31 and 32 are located on the same catching or stop circle having the radius R of the cam disks 54. Both dressing ends 11 and 12 are untensioned in this position, as is apparent from the archings 50 of the cylinder dressing 10 near the edges thereof.

Figure 3:
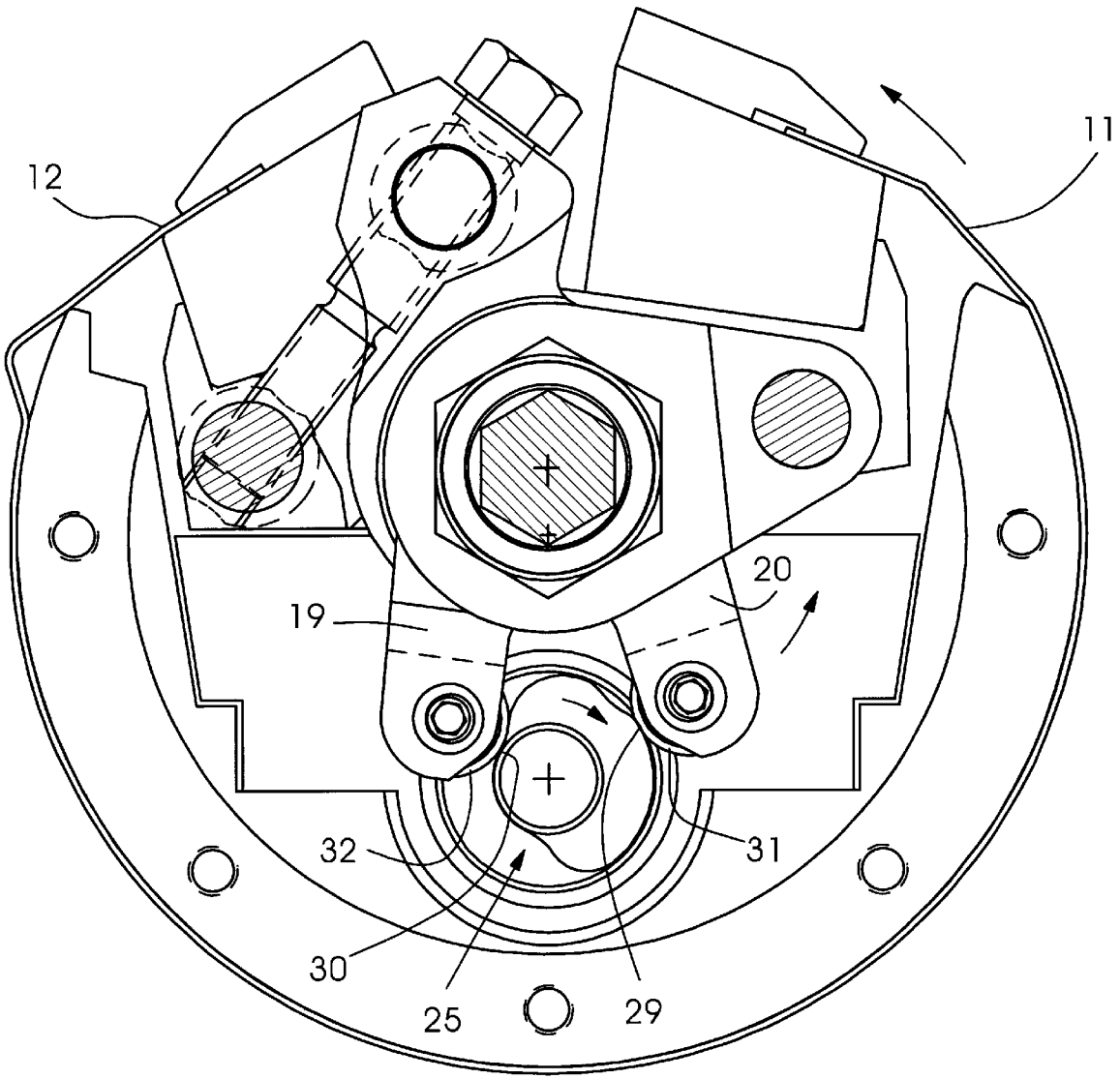
FIG. 3 is another view like that of FIG. 2 of the tensioning device, in another operating phase thereof, namely, in a second tensioning position thereof wherein a leading end of the dressing is untensioned, and a trailing end of the dressing is tensioned.

When the cam member 25 is rotated from the position thereof shown in FIG. 2 to the position thereof shown in FIG. 3, the trailing dressing end 11 is tensioned by the spring 41 via the second tension lever 19. At the same time, as a consequence of the cam contour, the cam member 25 enables the performance of a readjustment of the second tension lever 19 by the force of the spring 41. When, as shown, the roller 32 remains yet located in the lowest region of the S-shaped transition or, alternatively, is already completely in the cam region 30, the roller 31 remains in bearing contact in the cam region 27.

Figure 4:
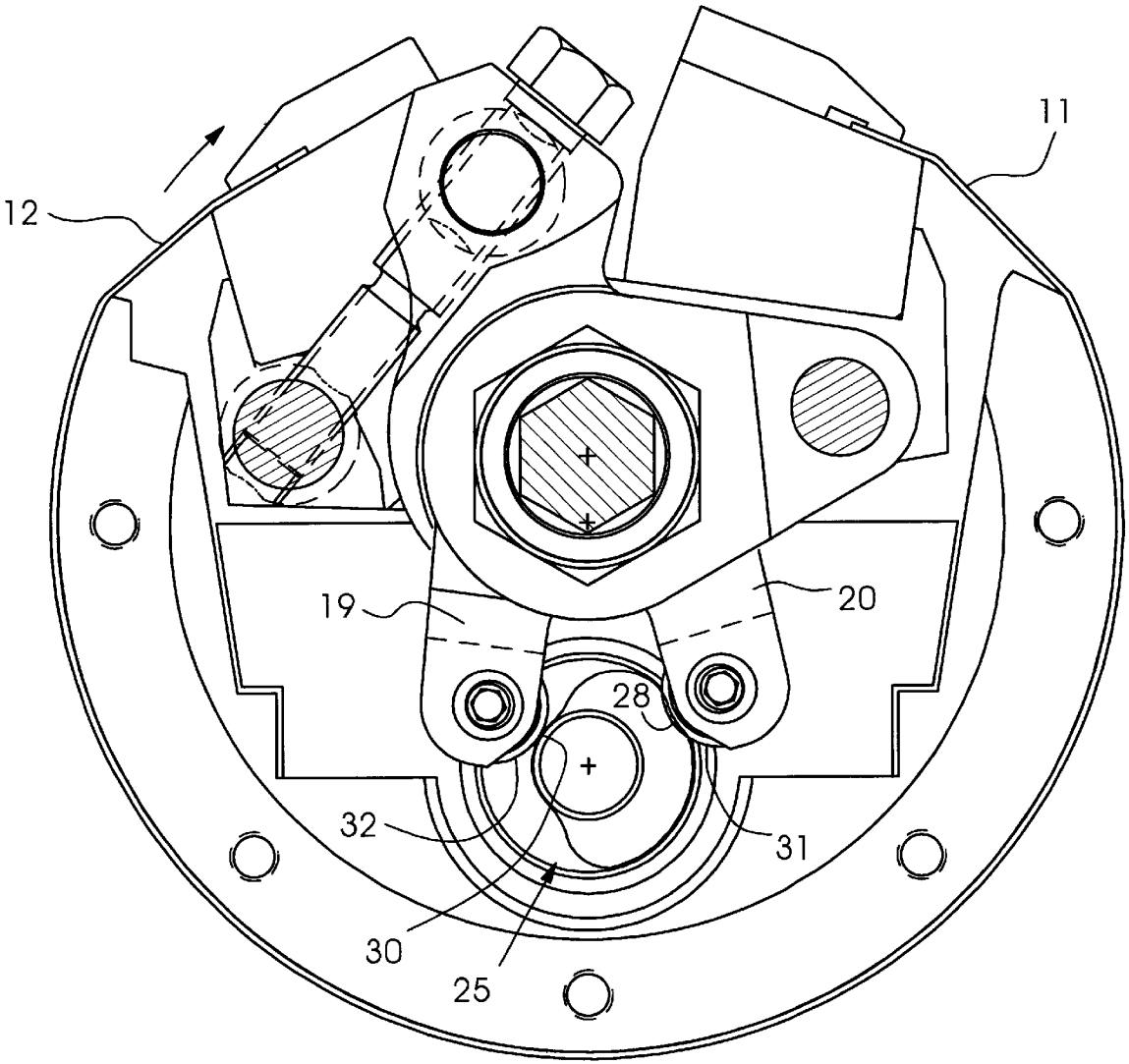
FIG. 4 is a further view like those of FIGS. 2 and 3 of the tensioning device, in a further operating phase, namely, in a third tensioning position thereof wherein both dressing ends are tensioned.

When the cam member 25 is rotated farther into the position shown in FIG. 4, then, the leading dressing end 12 is also tensioned, the cam member 25, due to the cam contour, enabling the first tension lever 20 to be readjusted by the force of the spring 41. This occurs when the rollers 32 penetrate into the recessed cam region 28, while the roller 32 rolls forward a specific distance on the cam region 30. Thereafter, neither of the rollers 31 and 32 is pressed against the cam member 25 any longer, and both dressing ends 11 and 12 are tautly tensioned.

Figure 5:
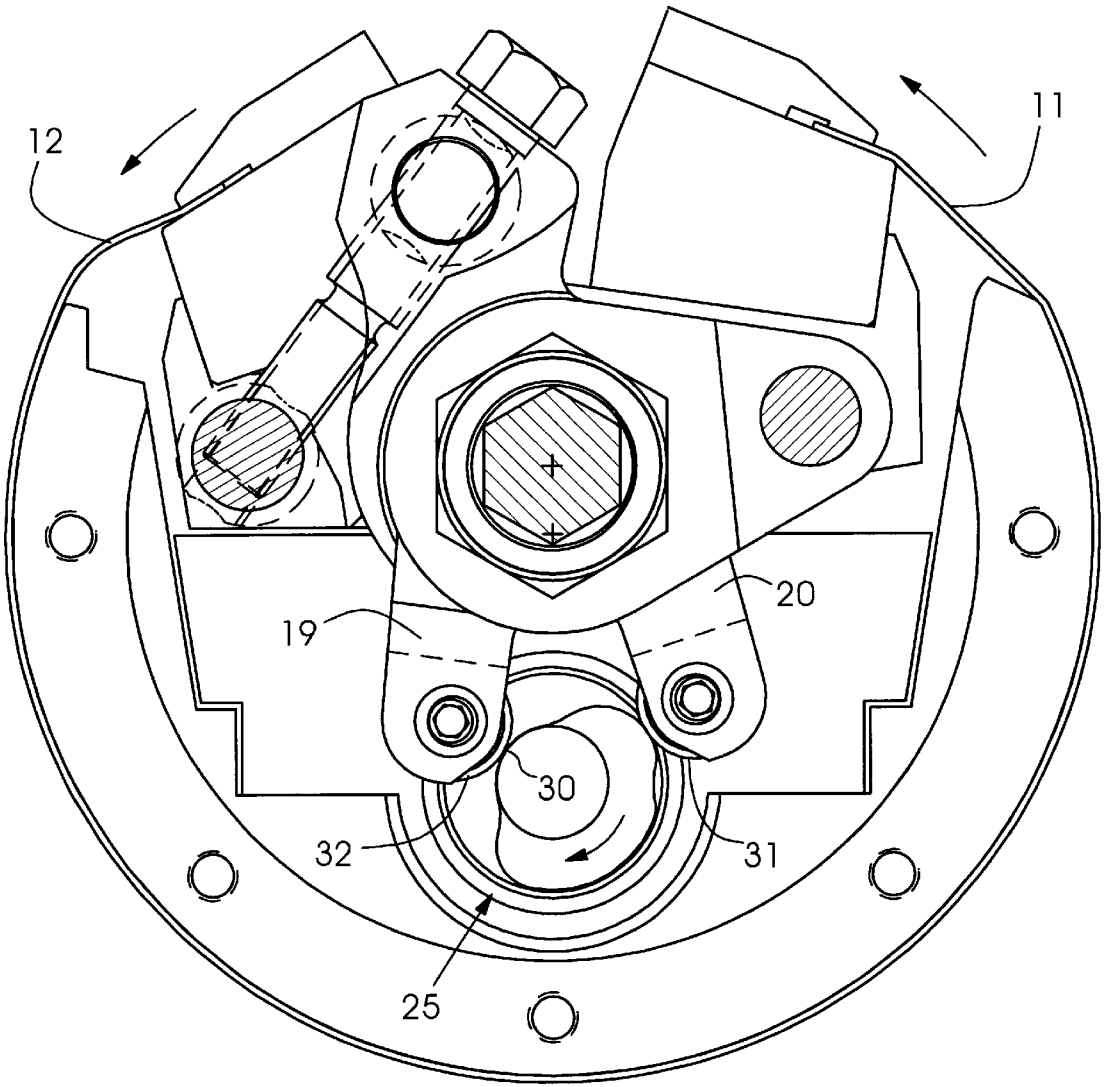
FIG. 5 is a fourth view like those of FIGS. 2, 3 and 4 of the tensioning device, in an additional operating phase, namely, in a fourth tensioning position wherein the leading dressing end is untensioned and the rear trailing dressing end is retensioned.

A further rotation of the cam member 25, as illustrated in FIG. 5, with the roller 31 emerging from the recessed cam region 28 and rolling into the cam region 27, causes the first tension lever 20 to be pressed away counter to the tensioning action of the spring 41 and, consequently, relieving the leading dressing end 12 of tension, the spring 41 compensating for this relief of tension by a simultaneous retensioning of the trailing dressing end 11.

Figure 6:
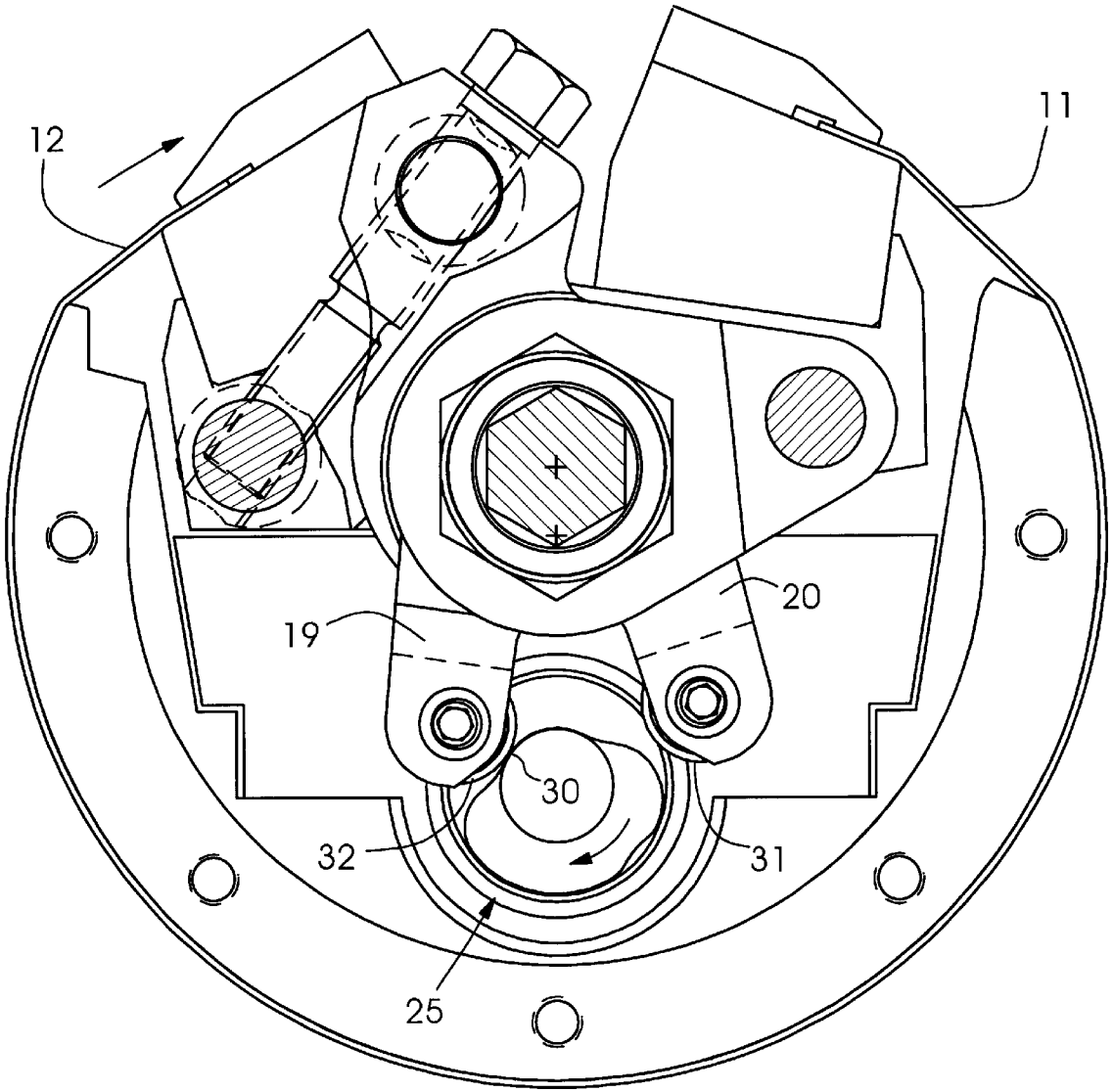
FIG. 6 is a fifth view like those of FIGS. 2 to 5 of the tensioning device, in yet another operating phase, namely, in a fifth tensioning position wherein both dressing ends are aligned precisely in position and are tensioned.

After the cam member 25 has been rotated for the last time, as illustrated in FIG. 6, the first tension lever 20 and the roller 31 thereof, respectively, are disengaged or come out of contact with the cam member 25, while the second tension lever 19, without pressing against or on the cam region 30, is located just in front of the mirror-symmetrically S-shaped transition on the cam member 25. The spring 41 can thereby apply tension to the leading dressing end 12 once more via the first tension lever 20, so that both dressing ends 11 and 12 are tautly tensioned again. The front dressing end 12 is now positioned precisely, and the air located under the cylinder dressing 10 in the region of the previously deformed dressing ends 11 and 12 is extracted completely, with the result that the archings 50 of the cylinder dressing 10 have been eliminated.

If required, it is now possible, in order to adjust the circumferential register, to jointly adjust the entire tension system by further rotating the cam member 25 which, in this case, presses against the second tension lever 19 and the roller 32 thereof, respectively, via the slowly ascending transitional region swung in a mirror-symmetrically S-shaped manner, the tension levers 19 and 20 and the dressing ends 11 and 12 therewith moving together clockwise and, simultaneously, maintaining the respective positions thereof relative to one another. The cam member 25 is thereafter reset into the position illustrated in FIG. 6.

We claim:

1. A device for holding and tensioning a cylinder dressing on a printing machine cylinder, the device comprising a first arm for holding a leading dressing end of the cylinder dressing, a second arm for holding a trailing dressing end of the cylinder dressing, a rotatable cam member for adjusting said first and second arms, a first rotary joint and a second rotary joint, a first tension lever pivotable about said first rotary joint, a second tension lever pivotable about said second rotary joint, said first arm being formed on said first tension lever, and said second arm being formed on said second tension lever, and a single spring extending through said first rotary joint and through said second rotary joint.

2. The device according to claim 1, wherein said tension levers are loaded by said single spring.

3. The device according to claim 1, wherein said first rotary joint and said second rotary joint are disposed coaxially with one another.

4. The device according to claim 1, wherein said rotary joints are disposed so as to be offset eccentrically relative to an axis of rotation of the printing-machine cylinder.

5. The device according to claim 1, wherein said single spring is a torsion bar spring.

6. The device according to claim 1, wherein said tension levers are formed as rockers, and each of said rockers has a first rocker arm for holding the cylinder dressing, and a second rocker arm actuatable by the cam member.

7. The device according to claim 6, including a respective roller engageable by the cam member being mounted rotatably in each of said second rocker arms.

8. The device according to claim 1, further comprising a first clamping device carried on said first tension lever and a second clamping device carried on said second tension lever.

9. A printing machine having at least one device for holding and tensioning a cylinder dressing according to claim 1.

* * * * *